US011243017B2

(12) United States Patent
Chernov et al.

(10) Patent No.: US 11,243,017 B2
(45) Date of Patent: Feb. 8, 2022

(54) DRAINED PLUMBING SYSTEM FOR AN ICE MAKER

(71) Applicant: Haier US Appliance Solutions, Inc., Wilmington, DE (US)

(72) Inventors: Gregory Sergeevich Chernov, Louisville, KY (US); Bradley Nicholas Gilkey, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 93 days.

(21) Appl. No.: 16/564,309

(22) Filed: Sep. 9, 2019

(65) Prior Publication Data

US 2021/0071928 A1 Mar. 11, 2021

(51) Int. Cl.
*F25C 1/25* (2018.01)

(52) U.S. Cl.
CPC ..... *F25C 1/25* (2018.01); *F25C 2400/14* (2013.01)

(58) Field of Classification Search
CPC ..... F25C 1/25; F25C 2400/14; F25D 23/126; F25D 2323/121; F25D 2323/122
See application file for complete search history.

(56) References Cited

U.S. PATENT DOCUMENTS

| | | | | |
|---|---|---|---|---|
| 2,997,860 | A * | 8/1961 | Muffly | F25C 5/24 62/344 |
| 3,411,554 | A * | 11/1968 | Wilson | F25C 1/25 141/351 |
| 8,756,950 | B2 | 6/2014 | Brunner et al. | |
| 9,273,894 | B1 * | 3/2016 | Whitty | F25C 1/00 |
| 9,404,683 | B2 | 8/2016 | Miller et al. | |
| 10,001,312 | B2 | 6/2018 | Nuss et al. | |
| 2002/0053210 | A1 * | 5/2002 | Koster | F25C 1/06 62/3.63 |
| 2012/0111048 | A1 * | 5/2012 | Kim | F25D 23/126 62/344 |
| 2016/0101989 | A1 * | 4/2016 | An | B01D 35/30 210/254 |

* cited by examiner

*Primary Examiner* — Cassey D Bauer
(74) *Attorney, Agent, or Firm* — Dority & Manning, P.A.

(57) ABSTRACT

A plumbing system for an ice maker may include a supply line extending to a dispense point and a dispense valve coupled to the supply line. An ice maker is coupled to the recirculation line, and a pump is also coupled to the recirculation line. The pump is operable to recirculate liquid through the ice maker via the recirculation line. The plumbing system also include features for draining water from the recirculation line.

16 Claims, 7 Drawing Sheets

DRAINED PLUMBING SYSTEM FOR AN ICE MAKER

FIELD OF THE INVENTION

The present subject matter relates generally to clear ice makers for appliances.

BACKGROUND OF THE INVENTION

Appliances with ice makers are generally plumbed to a water supply, and water from the water supply flows to the ice maker. Within the ice maker, the water is frozen to form ice. The ice makers are frequently cooled by a sealed system, and heat transfer between liquid water in the ice maker and refrigerant of the sealed system generates the ice.

Forming ice with appliances plumbed to water supplies can be challenging. For instance, separated solids from tap water can accumulate and negatively affect ice maker performance in appliances with water recirculation systems for the ice maker.

BRIEF DESCRIPTION OF THE INVENTION

Aspects and advantages of the invention will be set forth in part in the following description, or may be apparent from the description, or may be learned through practice of the invention.

In certain example embodiments, a plumbing system for an ice maker may include a supply line extending to a dispense point and a dispense valve coupled to the supply line. The dispense valve is operable to regulate liquid flow through the supply line to the dispense point. A recirculation line has an inlet and an outlet. The inlet and outlet of the recirculation line are connected to the supply line. The inlet of the recirculation line is connected to the supply line upstream of the dispense valve. An ice maker is coupled to the recirculation line. An ice maker valve is coupled to the recirculation line. The ice maker valve is operable to regulate liquid flow through the ice maker on the recirculation line. A reservoir is coupled to the recirculation line, and a pump is also coupled to the recirculation line. The pump is operable to recirculate liquid from the reservoir through the ice maker via the recirculation line. A recirculation check valve is coupled to the recirculation line. The recirculation check valve blocks backward liquid flow through the recirculation line.

In some example embodiments, a plumbing system for an ice maker may include a supply line extending to a dispense point and a dispense valve coupled to the supply line. The dispense valve is operable to regulate liquid flow through the supply line to the dispense point. The plumbing system may also include a recirculation loop and a recirculation inlet line connected to the supply line and the recirculation loop. An ice maker valve is coupled to the recirculation inlet line. The ice maker valve is operable to regulate liquid flow into the recirculation loop through the recirculation inlet line. A recirculation outlet line is connected to the supply line and the recirculation loop. A drain check valve is coupled to the recirculation outlet line. The drain check valve blocks liquid flow into the recirculation loop through the recirculation outlet line. A recirculation check valve is coupled to the recirculation loop. The recirculation check valve blocks backward liquid flow through the recirculation loop. An ice maker, a reservoir and a pump are coupled to the recirculation loop. The pump is operable to recirculate liquid from the reservoir through the ice maker via the recirculation loop. An opening pressure of the drain check valve is less than an opening pressure greater of the recirculation check valve.

In particular example embodiments, a plumbing system for an ice maker may include a supply line extending to a dispense point and a dispense valve coupled to the supply line. The dispense valve is operable to regulate liquid flow through the supply line to the dispense point. The plumbing system may also include a recirculation loop and a recirculation inlet line connected to the supply line and the recirculation loop. An ice maker valve is coupled to the recirculation inlet line. The ice maker valve is operable to regulate liquid flow into the recirculation loop through the recirculation inlet line. A drain line is connected to the recirculation loop. The drain line extends to an additional dispense point or extends to the supply line downstream of the dispense valve. A drain check valve is coupled to the drain line. The drain check valve blocks backward liquid flow through the drain line. A recirculation valve is coupled to the recirculation loop. The recirculation valve is operable to block liquid flow through the recirculation loop. An ice maker, a reservoir, and a pump are coupled to the recirculation loop. The pump is operable to recirculate liquid from the reservoir through the ice maker via the recirculation loop.

In various example embodiments, a plumbing system for an ice maker may include a supply line extending to a dispense point and a dispense valve coupled to the supply line. The dispense valve is operable to regulate liquid flow through the supply line to the dispense point. The plumbing system also includes a recirculation loop. A recirculation inlet line is connected to the supply line and the recirculation loop, and an ice maker valve is coupled to the recirculation inlet line. The ice maker valve is operable to regulate liquid flow into the recirculation loop through the recirculation inlet line. A drain line is connected to the recirculation loop. The drain line extends to an additional dispense point or extends to the supply line downstream of the dispense valve. A drain valve is coupled to the drain line. The drain valve is operable to block liquid flow through the drain line. A recirculation check valve is coupled to the recirculation loop. The recirculation check valve blocks backward liquid flow through the recirculation loop. An ice maker, a reservoir, and a pump are coupled to the recirculation loop. The pump is operable to recirculate liquid from the reservoir through the ice maker via the recirculation loop.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
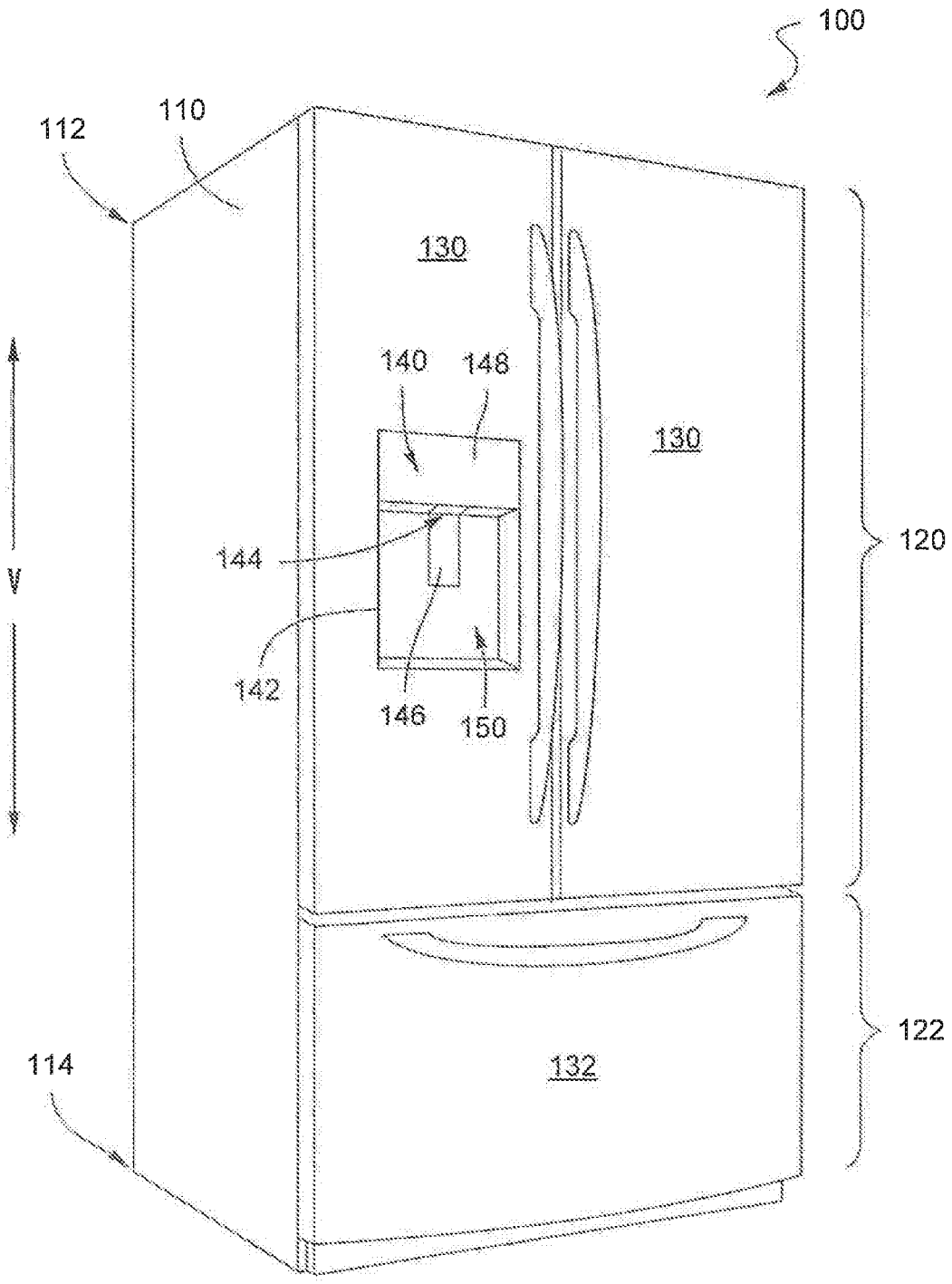
FIG. 1 is a front view of a refrigerator appliance according to an example embodiment.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of a refrigerator appliance 100 according to an exemplary embodiment. Refrigerator appliance 100 includes a cabinet or housing 110 that extends between a top portion 112 and a bottom portion 114 along a vertical direction V. Housing 110 defines chilled chambers for receipt of food items for storage. In particular, housing 110 defines a fresh food chamber 120 positioned at or adjacent top portion 112 of housing 110 and a freezer chamber 122 arranged at or adjacent bottom portion 114 of housing 110. As such, refrigerator appliance 100 is generally referred to as a "bottom mount refrigerator." It is recognized, however, that the benefits of the present disclosure apply to other types and styles of refrigerator appliances such as, e.g., a top mount refrigerator appliance, a side-by-side style refrigerator appliance, or a stand-alone ice maker appliance. Consequently, the description set forth herein is for illustrative purposes only and is not intended to be limiting in any aspect to any particular chilled chamber configuration.

Refrigerator doors 130 are rotatably hinged to an edge of housing 110 for selectively accessing fresh food chamber 120. In addition, a freezer door 132 is arranged below refrigerator doors 130 for selectively accessing freezer chamber 122. Freezer door 132 is coupled to a freezer drawer (not shown) slidably mounted within freezer chamber 122. Refrigerator doors 130 and freezer door 132 are shown in a closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 130. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
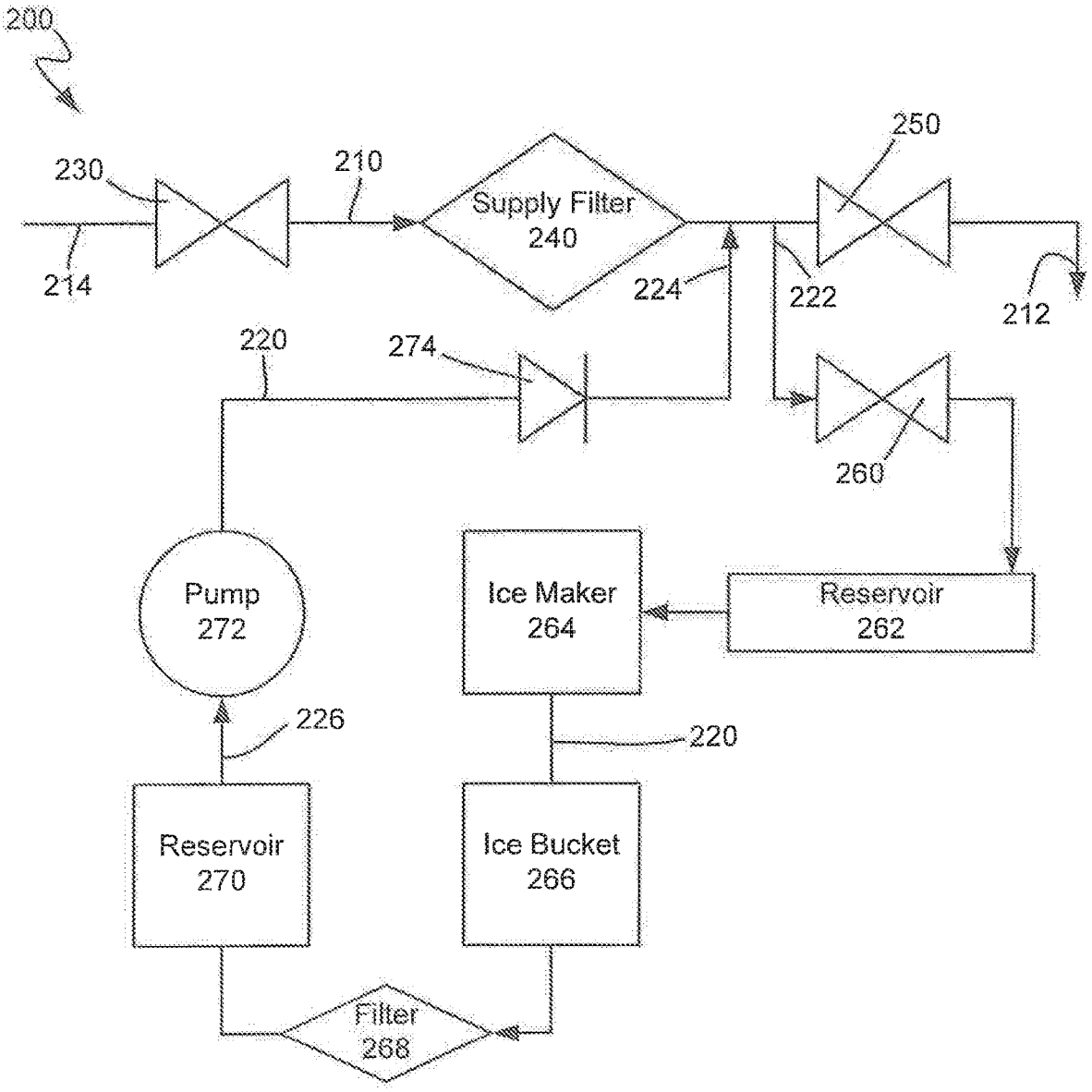
FIG. 2 is a schematic view of a plumbing system according to a first example embodiment.

FIG. 2 is a schematic view of an ice maker plumbing system 200. Plumbing system 200 may be used in or with refrigerator appliance 100 (FIG. 1) to provide water to an ice maker within refrigerator appliance 100. Thus, plumbing system 200 is described in greater detail below in the context of refrigerator appliance 100. However, plumbing system 200 may also be used in or with any other suitable appliance, such as a standalone ice maker appliance, in alternative example embodiments. As discussed in greater detail below, plumbing system 200 includes features for facilitating draining of plumbing system 200, e.g., without requiring expensive and/or numerous components. Such features may assist with limiting or preventing deposit buildup within plumbing system 200 due to impurities that are naturally present within or introduced into water within plumbing system 200.

As shown in FIG. 2, plumbing system 200 includes a supply line 210. Supply 210 extends to a dispense point 212 and includes an inlet 214. Inlet 214 of supply line 210 may in fluid communication with a water supply, such as a municipal water supply or well, and water (e.g., tap water) from the water supply may flow into supply line 210 at inlet 214. Water in supply line 210 may exit supply line 210 at dispense point 212. Dispense point 212 may correspond to an outlet in dispenser recess 150. Thus, plumbing system 200 may supply liquid water to dispenser recess 150 in response to triggering of actuating mechanism 146. A supply filter 240, such as a replaceable filter cartridge with an activated carbon block, may be coupled to supply line 210, and supply filter 240 may filter the water flowing through supply line 210.

An isolation valve 230 may be coupled to supply line 210. Isolation valve 230 may be closed to terminate the flow of water through supply line 210. Isolation valve 230 is upstream of other components of plumbing system 200, including dispense point 212, supply filter 240, etc., on supply line 210. Isolation valve 230 may be open during certain operation cycles of plumbing system 200, such as a filling cycle, and closing of isolation valve 230 may terminate the flow of water to the downstream components of plumbing system 200, e.g., during ice making, recirculation and/or drain cycles. Isolation valve 230 may be closed, e.g., during servicing of plumbing system 200, in response to leaks from plumbing system 200, etc. In certain example embodiments, isolation valve 230 is normally closed and is opened only when plumbing system 200 requires more water. Isolation valve 230 may be a solenoid valve, a mechanically operated valve, etc.

A dispense valve 250 is also coupled to supply line 210. Dispense valve 250 may be positioned downstream of supply filter 240 and upstream of dispense point 212 on supply line 210. When dispense valve 250 is closed, dispense valve 250 blocks water within supply line 210 from flowing to dispense point 212. Conversely, dispense valve 250 may be opened to flow water in supply line 210 to dispense point 212. Thus, dispense valve 250 may be normally closed and may open to flow water out of supply line 210 at dispense point 212, e.g., in response to triggering of actuating mechanism 146. Thus, dispense valve 250 is operable to regulate liquid flow through supply line 210 to dispense point 212. Dispense valve 250 may be a solenoid valve, a mechanically operated valve, etc.

A recirculation line 220 has an inlet 222 and an outlet 224. Inlet and outlet 222, 224 of recirculation line 220 are connected to supply line 210. Water in supply line 210 may flow into recirculation line 220 at inlet 222 of recirculation line 220. Conversely, water in recirculation line 220 may flow into supply line 210 at outlet 224 of recirculation line 220. Inlet 222 of recirculation line 220 is connected to supply line 210 upstream of dispense valve 250. Thus, water in supply line 210 may enter recirculation line 220 at inlet 222 regardless of whether dispense valve 250 is open or closed.

Various components of plumbing system 200 are coupled to recirculation line 220. For example, plumbing system 200 includes one or more of an ice maker valve 260, a reservoir 262, an ice maker 264, an ice bucket 266, an ion exchange or mineral adjusting filter 268, a reservoir 270 and a pump 272 coupled to recirculation line 220. Thus, water in recirculation line 220 may flow through reservoir 262, ice maker 264, ice bucket 266, ion exchange filter 268, reservoir 270 and/or pump 272. Water in recirculation line 220 may recirculate through such components during operation of pump 272, as discussed in greater detail below.

Ice maker valve 260 is coupled to recirculation line 220, e.g., downstream of inlet 222 and upstream of ice maker 264. When ice maker valve 260 is closed, ice maker valve 260 blocks water within supply line 210 from flowing into recirculation line 220, e.g., when dispense valve 250 is also open. Conversely, ice maker valve 260 may be opened to allow recirculating water flow within supply line 210, e.g., during operation of pump 272. Thus, ice maker valve 260 may be normally open and may close to block water flow into recirculation line 220 when dispense valve 250 is also open. Accordingly, ice maker valve 260 may be operable to regulate liquid flow through ice maker 264 on recirculation line 220. Ice maker valve 260 may be a solenoid valve, a mechanically operated valve, etc.

Reservoir 262 is connected to recirculation line 220, and water within recirculation line 220 may fill reservoir 262. Reservoir 262 is positioned upstream of ice maker 264 on recirculation line 220 and may be an ice maker reservoir. Thus, reservoir 262 may provide a volume of water for use in ice maker 264 to form ice cubes. Reservoir 262 may be sized to hold a suitable volume of liquid. For example, reservoir 262 may be sized to hold no more than a half-gallon (½ gal.) of water and no less than a tenth of a gallon (0.1 gal.) of water. Such sizing of reservoir 262 advantageously provides a reserve of liquid water to operate ice maker 264.

Ice maker 264 is connected to recirculation line 220, e.g., downstream of reservoir 262. Ice maker 264 may be a nugget ice maker that freezes liquid water on an inner surface of a casing, shears ice flakes from the inner surface of the casing with a rotating auger, and extrudes the ice flakes through a die to form nugget ice. Ice bucket 266 receives and stores ice cubes formed in ice maker 264.

Residual liquid water from ice maker 264 and/or melt water from ice cubes in ice bucket 266 flows through ion exchange filter 268. Thus, ion exchange filter 268 may be connected to recirculation line 220 downstream of ice maker 264 and ice bucket 266, e.g., and upstream of reservoir 270. By flowing water in recirculation line 220 through ion exchange filter 268, fouling of ice maker 264 with deposit buildup may be avoided or limited. In particular, ion exchange filter 268 may remove impurities or particles from water flowing through recirculation line 220. Ion exchange filter 268 may be a filter cartridge removably mounted to recirculation line 220.

Reservoir 270 is connected to recirculation line 220, and water within recirculation line 220 may fill reservoir 270. Reservoir 270 is positioned upstream of pump 272 on recirculation line 220 and may be a pump reservoir. Thus, reservoir 270 may provide a volume of water for use by pump 270 to avoid dry running pump 270. Pump 270 is coupled to recirculation line 220 and is operable to recirculate water from reservoir 262 and/or reservoir 270 through recirculation line 220. Reservoir 270 may be sized to hold a suitable volume of liquid. For example, reservoir 270 may be sized to hold no more than a half-gallon (½ gal.) of water and no less than a tenth of a gallon (0.1 gal.) of water. Such sizing of reservoir 270 advantageously provides a reserve of liquid water to operate pump 270.

A recirculation check valve 274 is coupled to recirculation line 220, e.g., upstream of outlet 224 and downstream of pump 272. Recirculation check valve 274 blocks backward liquid flow through recirculation line 220. For example, recirculation check valve 274 may close and block liquid flowing into recirculation line 220 via outlet 224 of recirculation line 220. Conversely, recirculation check valve 274 may open in response to pump 272 drawing water into inlet 222 of recirculation line 220 and urging water out of outlet 224 of recirculation line 220.

The arrangement of plumbing system 200 described above may advantageously allow draining of plumbing system 200. In particular, outlet 224 of recirculation line 220 that is regulated by recirculation check valve 274 may be positioned upstream of inlet 222 of recirculation line 220 that is regulated by ice maker valve 260. To fill recirculation line 220 (e.g., and reservoirs 262, 270) for operation of ice maker 264, ice maker valve 260 and isolation valve 230 are opened, and dispense valve 250 is closed to flow water from supply line 210 into recirculation line 220 and thus ice maker 264. To drain recirculation line 220, ice maker valve 260 and isolation valve 230 are closed, and dispense valve 250 is opened, and pump 272 is activated to flow water from recirculation line 220 into supply line 210 and then to dispense point 212. Thus, water in recirculation line 220 may be drained to dispense point 212, and recirculation line 220 may be subsequently filled with fresh water from supply line 210 to avoid fouling ice maker 264 (or other components of plumbing system 200) with accumulated impurities and particles. As may be seen from the above, plumbing system 200 may utilize dispense point 212 to drain plumbing system 200 and thus need not include a separate drain outlet.

It will be understood that the particular arrangement of components on recirculation line 220 is provided by way of example only. Other arrangements are within the scope of the present application except where expressly indicated otherwise.

Figure 3:
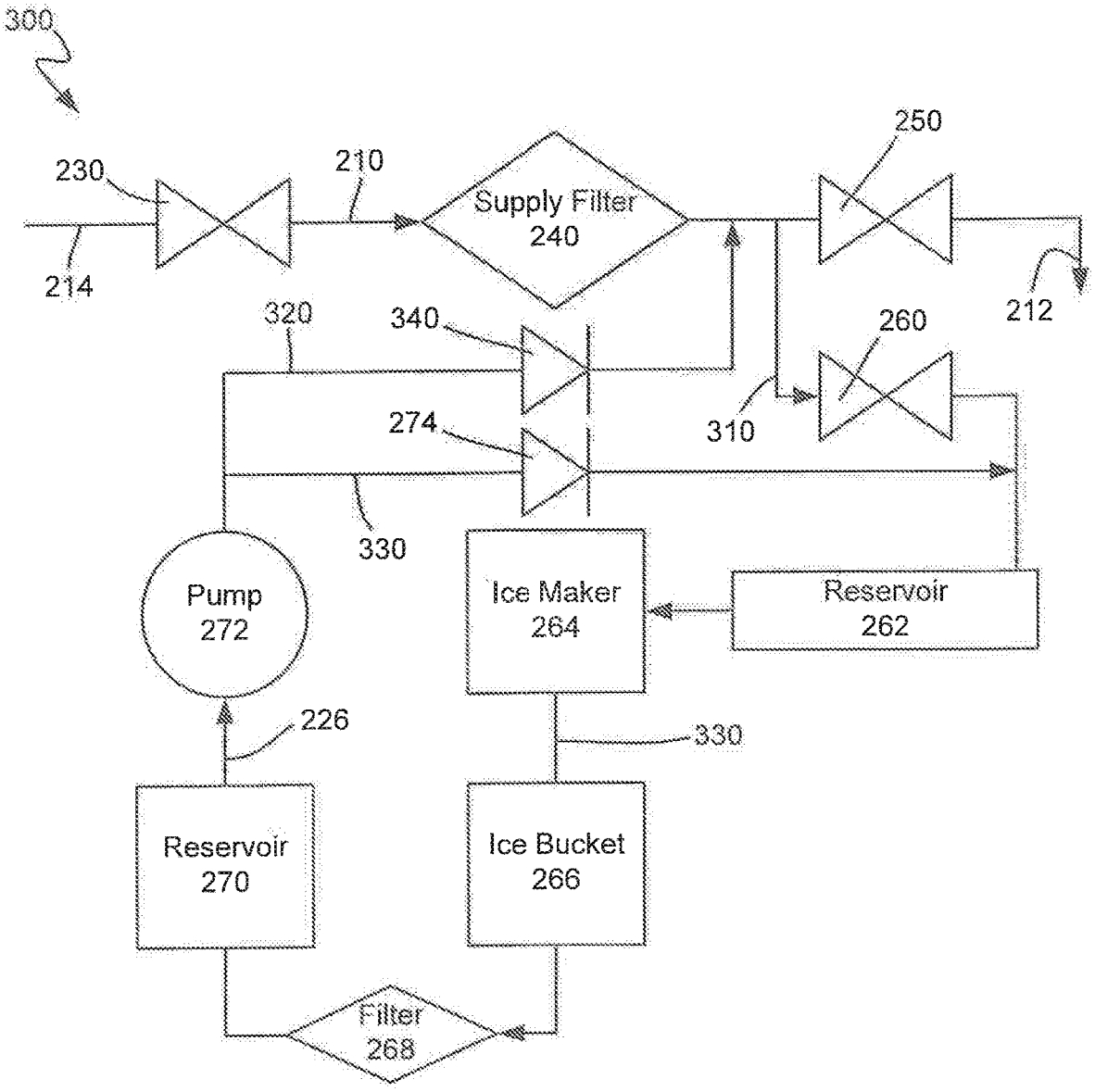
FIG. 3 is a schematic view of a plumbing system according to a second example embodiment.

FIG. 3 is a schematic view of an ice maker plumbing system 300. Plumbing system 300 includes numerous common components with plumbing system 200 (FIG. 2) described above. The description of such common components is omitted for the sake of brevity, but the differences between plumbing system 300 and plumbing system 200 are discussed in greater detail below.

As shown in FIG. 3, plumbing system 300 includes a recirculation inlet line 310, a recirculation outlet line 320, and a recirculation loop 330. Recirculation loop 330 is separate from supply line 210. Thus, water within recirculation loop 330 can flow within recirculation loop 330 without passing through supply line 210 during operation of pump 272. Conversely, turning back to FIG. 2, recirculation line 220 and a portion of supply line 210 collectively form a recirculation loop 226 in plumbing system 200. Thus, water within recirculation loop 226 flows through the portion of supply line 210 during circulation of water in recirculation loop 226 generated by pump 272.

With reference to FIG. 3, recirculation inlet line 310 is connected to supply line 210 and recirculation loop 330. Water from supply line 210 may flow into recirculation loop 330 via recirculation inlet line 310. Ice maker valve 260 is coupled to recirculation inlet line 310 and regulates water flow into recirculation loop 330 through recirculation inlet line 310. Recirculation outlet line 320 is also connected to supply line 210 and recirculation loop 330. Water from recirculation loop 330 may flow into supply line 210 via recirculation outlet line 320. As may be seen from the above, recirculation inlet and outlet lines 320, 330 allow water from supply line 210 to flow into and out of recirculation loop 330. Recirculation outlet line 320 may be positioned upstream of recirculation inlet line 310 on supply line 210.

Recirculation check valve 274 is coupled to recirculation loop 330, e.g., between recirculation inlet and outlet lines 320, 330. Recirculation check valve 274 blocks backward water flow through recirculation loop 330. For example, recirculation check valve 274 may close and block water entering recirculation loop 330 at recirculation inlet line 310 from directly entering recirculation outlet line 320 and thus bypassing other components on recirculation loop 330. Conversely, recirculation check valve 274 may open and allow water in recirculation loop 330 to flow between recirculation inlet and outlet lines 320, 330 within recirculation loop 330, e.g., directly from pump 272 to reservoir 262 or ice maker 264, when pump 272 is activated.

A drain check valve 340 is coupled to recirculation outlet line 320 and blocks water from flowing into recirculation loop 330 through recirculation outlet line 320. Thus, e.g., drain check valve 340 closes and blocks water from flowing into recirculation loop 330 through recirculation outlet line 320 when ice maker valve 260 is closed. Conversely, e.g., drain check valve 340 opens and allows water from recirculation loop 330 to exit recirculation loop 330 via recirculation outlet line 320. An opening pressure for drain check valve 340 may be less than an opening pressure for recirculation check valve 274 to provide for proper draining of plumbing system 300.

The arrangement of plumbing system 300 described above may advantageously allow draining of plumbing system 300. To fill recirculation loop 330 for operation of ice maker 264, ice maker valve 260 and isolation valve 230 are opened, and dispense valve 250 is closed to flow water from supply line 210 into recirculation loop 330 via recirculation inlet line 310 and thus into ice maker 264 (e.g., and reservoirs 262, 270). To drain recirculation loop 330, ice maker valve 260 and isolation valve 230 are closed, dispense valve 250 is opened, and pump 272 is activated to flow water from recirculation loop 330 into supply line 210 via recirculation outlet line 320 and then to dispense point 212. Thus, water in recirculation loop 330 may be drained to dispense point 212, and recirculation loop 330 may be subsequently filled with fresh water from supply line 210 to avoid fouling ice maker 264 (or other components of plumbing system 300) with accumulated impurities and particles. As may be seen from the above, plumbing system 300 may utilize dispense point 212 to drain plumbing system 300 and thus need not include a separate drain outlet.

In FIG. 3, the location of the coupling of recirculation outlet line 320 to recirculation loop 226 is provided by way of example only and may be moved in alternative example embodiments. For example, the coupling of recirculation outlet line 320 to recirculation loop 226 may be located between reservoir 262 and ice maker 264.

Figure 4:
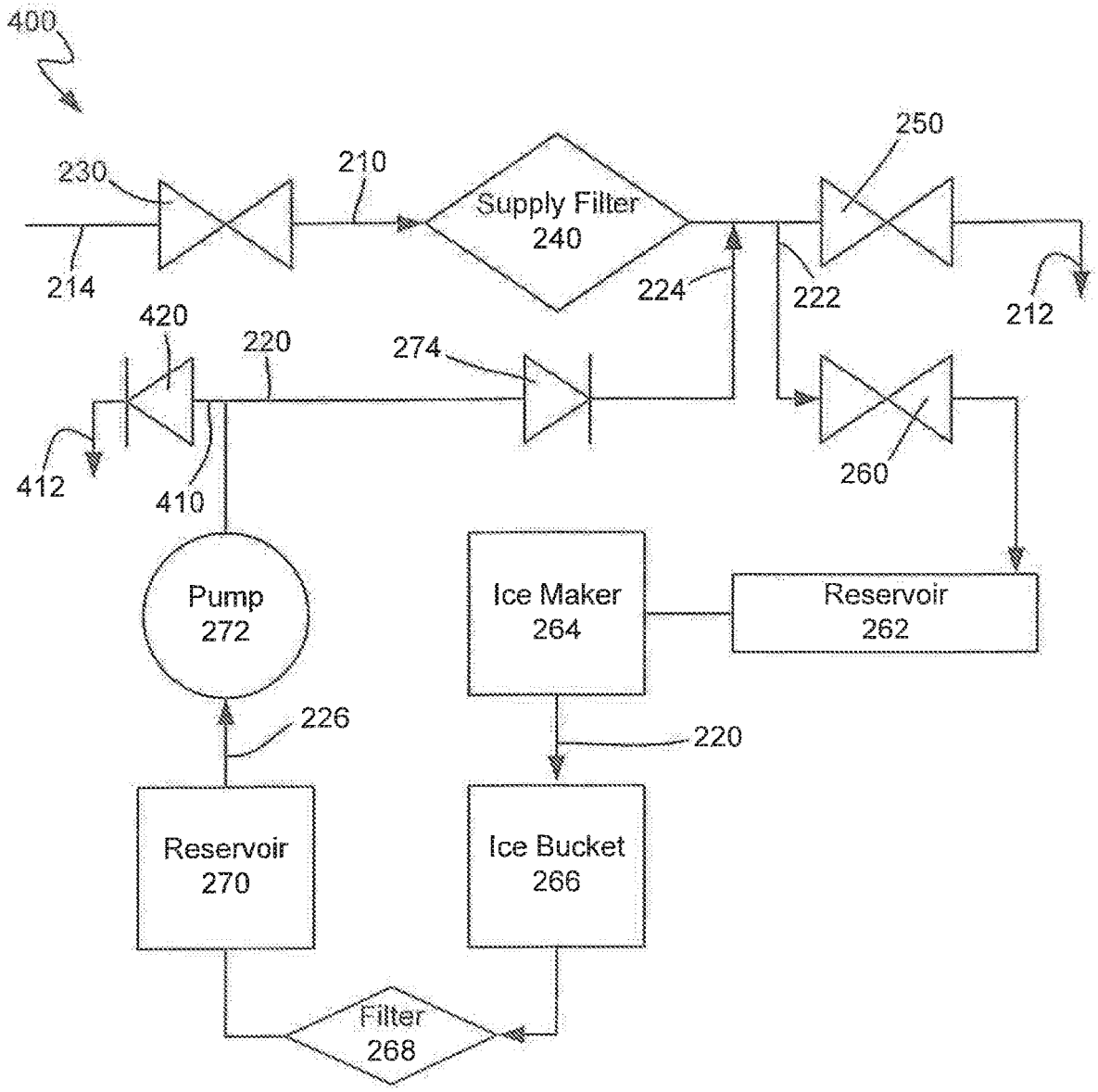
FIG. 4 is a schematic view of a plumbing system according to a third example embodiment.

FIG. 4 is a schematic view of an ice maker plumbing system 400. Plumbing system 400 includes numerous common components with plumbing system 200 (FIG. 2) described above. The description of such common components is omitted for the sake of brevity, but the differences between plumbing system 400 and plumbing system 200 are discussed in greater detail below.

As shown in FIG. 4, plumbing system 400 includes a drain line 410 and a drain check valve 420. Drain line 410 is connected to recirculation line 220 and extends to an additional dispense point 412. Additional dispense point 412 is separate from dispense point 212 and may be located at any suitable location on door 128, housing 120, etc. Water within recirculation line 220 may exit recirculation line 220 via drain line 410 to additional dispense point 412, as discussed in greater detail below. Drain check valve 420 is coupled to drain line 410 and blocks water from flowing into recirculation line 220 through drain line 410. Thus, drain check valve 420 provides one-way water flow through drain line 410. To avoid undesired draining of plumbing system 400, an opening pressure for drain check valve 420 is greater than a water pressure within recirculation line 220 during operation of pump 272 (e.g., and when ice maker valve 260 is open) to supply ice maker 264 with water, in certain example embodiments. In addition, the opening pressure for drain check valve 420 is greater than the opening pressure for recirculation check valve 274 to avoid undesired draining of plumbing system 400 and allow pump 272 to supply ice maker 264 with water, in certain example embodiments.

The arrangement of plumbing system 400 described above may advantageously allow draining of plumbing system 400. To fill recirculation line 220 for operation of ice maker 264, ice maker valve 260 and isolation valve 230 are opened, and dispense valve 250 is closed to flow water from supply line 210 into recirculation line 220 and thus into ice maker 264 (e.g., and reservoirs 262, 270). To drain recirculation line 220, ice maker valve 260, dispense valve 250, and isolation valve 230 are all closed, and pump 272 is activated to flow water from recirculation line 220 into drain line 410 and through drain check valve 420 then to additional dispense point 412. Thus, water in recirculation line 220 may be drained to additional dispense point 412, and recirculation line 220 may be subsequently filled with fresh water from supply line 210 to avoid fouling ice maker 264 (or other components of plumbing system 400) with accumulated impurities and particles. As may be seen from the above, plumbing system 400 may utilize additional dispense point 412 to drain plumbing system 300 and thus need not utilize the same dispense point 212 at which fresh water is dispensed to users at recess 150. During a recirculation cycle, isolation valve 230 and dispense valve 250 may be closed, ice maker valve 260 may be open, and pump 272 may be active or on. During the recirculation cycle, water may flow through recirculation line 220 and not drain out through drain line 410 because the opening pressure for drain check valve 420 is greater than the opening pressure for recirculation check valve 274.

Figure 5:
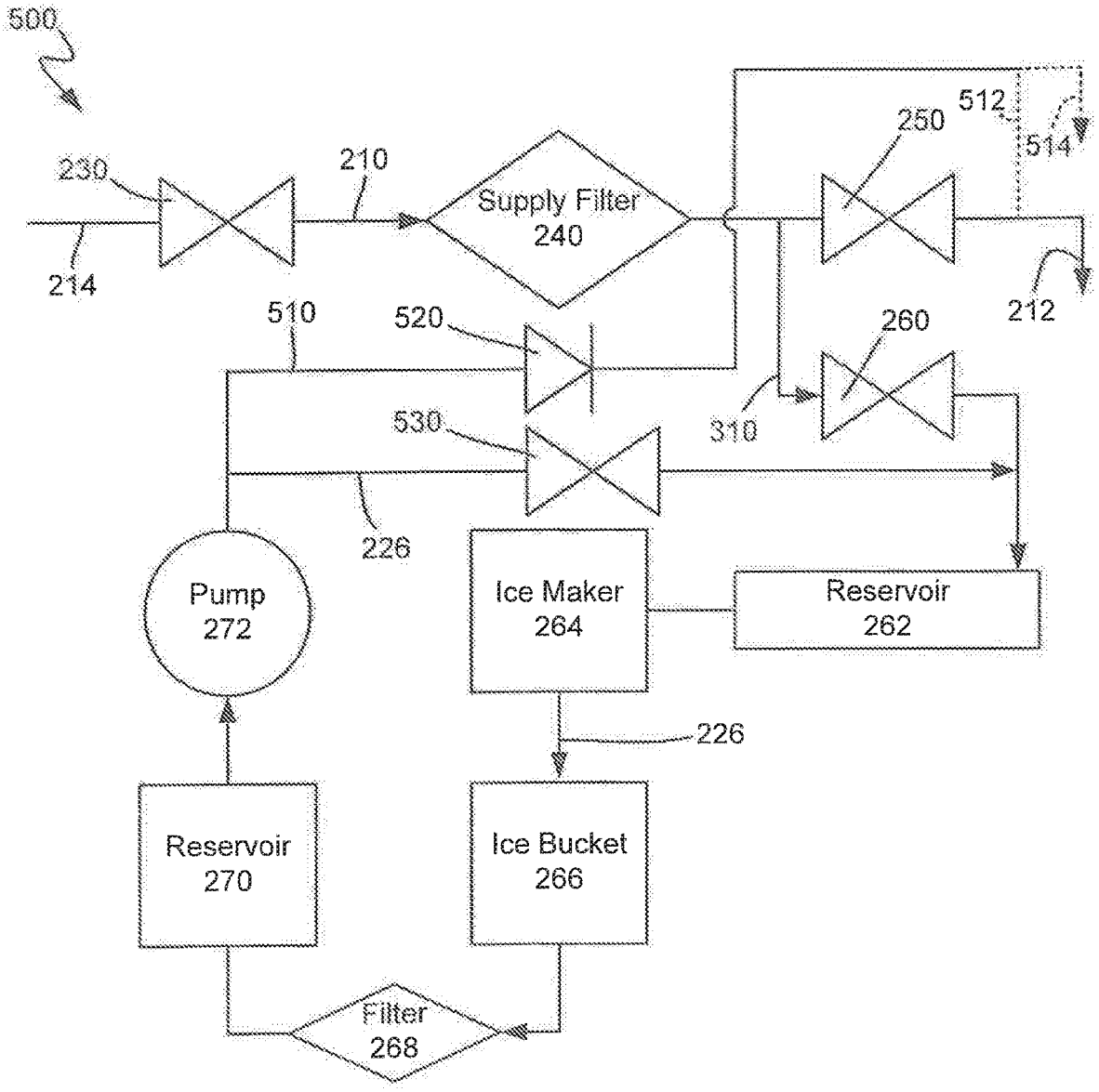
FIG. 5 is a schematic view of a plumbing system according to a fourth example embodiment.

FIG. 5 is a schematic view of an ice maker plumbing system 500. Plumbing system 500 includes numerous common components with plumbing systems 200, 300 (FIGS. 2 and 3) described above. The description of such common components is omitted for the sake of brevity, but the differences between plumbing system 500 and plumbing systems 200, 300 are discussed in greater detail below.

As shown in FIG. 5, plumbing system 500 includes a drain line 510, a drain check valve 520, and a recirculation valve 530. Drain line 510 is connected to recirculation loop 226. Water within recirculation loop 226 may exit recirculation loop 226 via drain line 510. Drain line 510 extends to supply line 210 downstream of dispense valve 250 or extends to an additional dispense point 514. Recirculation loop 226 is separate from supply line 210 in FIG. 5, and water within recirculation loop 226 can flow within recirculation loop 226 without passing through supply line 210 during operation of pump 272.

Drain check valve 520 is coupled to drain line 510. Drain check valve 520 blocks backward water flow from supply line 210. For example, drain check valve 520 prevents backflow when dispense valve 250 opens and water in supply line 210 pressurizes water in drain line 510 at a connection 512 of drain line 510 to supply line 210. As another example, drain check valve 520 allows water in recirculation loop 226 to exit recirculation loop 226 through drain line 510, e.g., when a water pressure in drain line 510/recirculation loop 226 exceeds the opening pressure for drain check valve 520 (e.g., and pump 272 is on and recirculation valve 530 is closed). Drain check valve 520 is sized so that the opening pressure of drain check valve 520 is greater than the water pressure in drain line 510/recirculation loop 226 during a recirculation cycle (e.g., and pump 272 is on and recirculation valve 530 is open), in certain example embodiments.

Recirculation valve 530 is coupled to recirculation loop 226, e.g., between drain line 510 and recirculation inlet line 310 and/or downstream to ice maker valve 260 as in FIG. 5. When recirculation valve 530 is closed, recirculation valve 530 blocks water flow through recirculation loop 226. Conversely, recirculation valve 530 may be opened to allow recirculating water flow within recirculation loop 226, e.g., during operation of pump 272. Thus, recirculation valve 530 may be normally open and may close to block water flow into recirculation loop 226. Thus, recirculation valve 530 is operable to regulate liquid flow through ice maker 264 on recirculation loop 226. Recirculation valve 530 may be a solenoid valve, a mechanically operated valve, etc.

The arrangement of plumbing system 500 described above may advantageously allow draining of plumbing system 500. To fill recirculation loop 226 for operation of ice maker 264, ice maker valve 260, isolation valve 230, and recirculation valve 530 are all opened, and dispense valve 250 is closed to flow water from supply line 210 into recirculation loop 226 and thus into ice maker 264 (e.g., and reservoirs 262, 270). To drain recirculation loop 226, ice maker valve 260, dispense valve 250, isolation valve 230 and recirculation valve 530 are all closed, and pump 272 is activated to flow water from recirculation line 220 into drain line 510 and through drain check valve 520 then to additional dispense point 514 or back into supply line 210 via connection 512. Thus, water in recirculation loop 226 may be drained to dispense point 212 or additional dispense point 512, and recirculation loop 226 may be subsequently filled with fresh water from supply line 210 to avoid fouling ice maker 264 (or other components of plumbing system 400) with accumulated impurities and particles.

Figure 6:
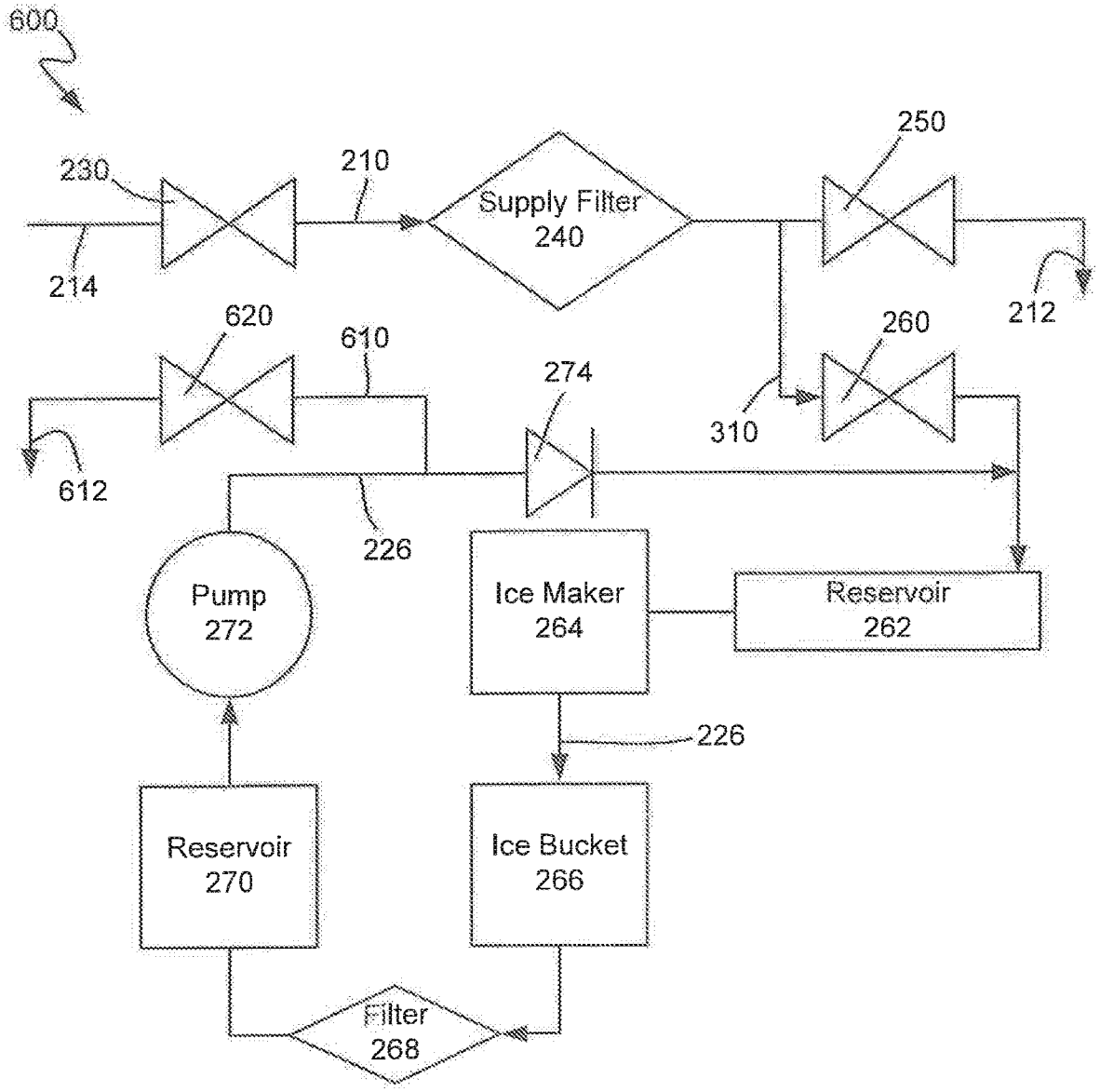
FIG. 6 is a schematic view of a plumbing system according to a fifth example embodiment.

FIG. 6 is a schematic view of a plumbing system 600. Plumbing system 600 includes numerous common components with plumbing systems 200, 300 (FIGS. 2 and 3) described above. The description of such common components is omitted for the sake of brevity, but the differences between plumbing system 600 and plumbing systems 200, 300 are discussed in greater detail below.

As shown in FIG. 6, plumbing system 600 includes a drain line 610 and a drain valve 620. Drain line 610 is connected to recirculation loop 226. Water within recirculation loop 226 may exit recirculation loop 226 via drain line 610. Drain line 610 extends to an additional dispense point 612. Recirculation loop 226 is separate from supply line 210 in FIG. 6 and water within recirculation loop 226 can flow within recirculation loop 226 without passing through supply line 210 during operation of pump 272.

Drain valve 620 is coupled to drain line 610. When drain valve 620 is closed, drain valve 620 blocks water flow out of recirculation loop 226 through drain line 610, e.g., during operation of pump 272. Conversely, drain valve 620 may be opened to allow water within recirculation loop 226 to flow out recirculation loop 226 through drain line 610. Thus, drain valve 620 may be normally closed and may open to allow water flow out of recirculation loop 226. Accordingly, drain valve 620 is operable to regulate liquid flow through drain line 610. Drain valve 620 may be a manual valve, a solenoid valve, a mechanically operated valve, etc.

The arrangement of plumbing system 600 described above may advantageously allow draining of plumbing system 600. To fill recirculation loop 226 for operation of ice maker 264, ice maker valve 260 and isolation valve 230 are opened, and dispense valve 250 and drain valve 620 are closed to flow water from supply line 210 into recirculation loop 226 and thus into ice maker 264 (e.g., and reservoirs 262, 270). To drain recirculation loop 226, drain valve 620 is opened, ice maker valve 260, dispense valve 250, and isolation valve 230 are all closed, and pump 272 is activated to flow water from recirculation line 220 into drain line 610 and through drain check valve 620 then to additional dispense point 612. Thus, water in recirculation loop 226 may be drained to additional dispense point 612, and recirculation loop 226 may be subsequently filled with fresh water from supply line 210 to avoid fouling ice maker 264 (or other components of plumbing system 400) with accumulated impurities and particles. To prevent water from entering recirculation loop 226 during a drain cycle, recirculation check valve 274 has an opening pressure greater than a water pressure in recirculation loop 226/drain line 610, e.g., when pump 272 is on and drain valve 620 is open, in certain example embodiments.

In FIG. 6, the location of the coupling of drain line 610 to recirculation loop 226 is provided by way of example only and may be moved in alternative example embodiments. For example, the coupling of drain line 610 to recirculation loop 226 may be located between reservoir 262 and ice maker 264. In addition, drain line 610 may extend to supply line 210 downstream of dispense valve 250, rather than to additional dispense point 612, in alternative example embodiments. Drain valve 620 may be an electromechanical valve, a manual valve or a fitting that automatically actuates when an optional drain tube is attached to additional dispense point 612.

Figure 7:
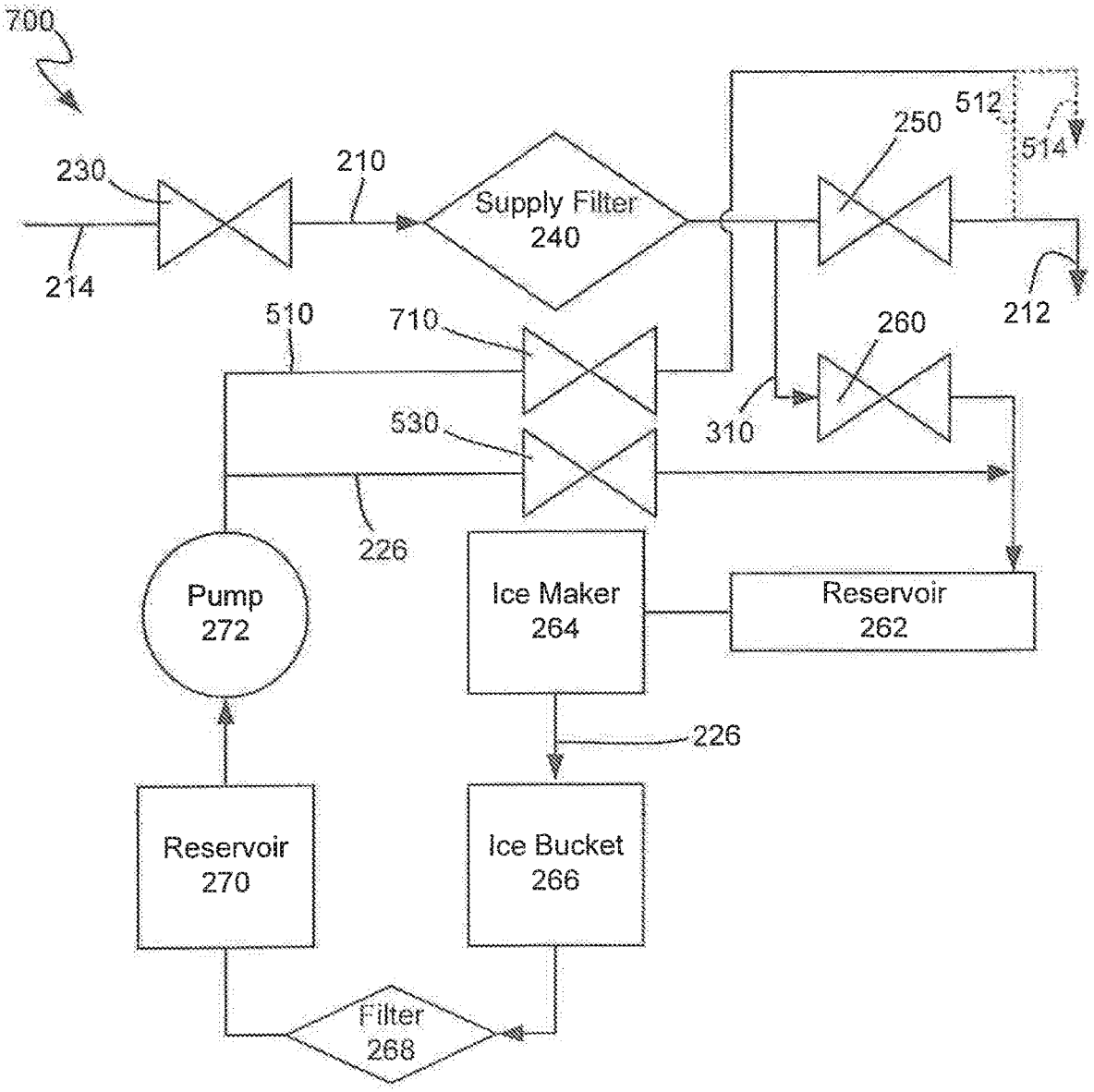
FIG. 7 is a schematic view of a plumbing system according to a sixth example embodiment.

FIG. 7 is a schematic view of a plumbing system 700. Plumbing system 700 includes numerous common components with plumbing systems 500 (FIG. 5) described above. The description of such common components is omitted for the sake of brevity, but the differences between plumbing system 700 and plumbing system 500 is discussed in greater detail below.

In plumbing system 700, a control valve 710 replaces drain check valve 520 from plumbing system 500. Control valve 710 may be a solenoid valve, a mechanically operated valve, etc. Control valve 710 is operated to provide the same flow control as drain check valve 520 in plumbing system 500.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A plumbing system for an ice maker, comprising:

a supply line extending to a dispense point, the dispense point positioned at a dispenser recess;

a dispense valve coupled to the supply line, the dispense valve operable to regulate liquid flow through the supply line to the dispense point, an actuating mechanism for the dispense valve positioned at the dispenser recess;

a recirculation line having an inlet and an outlet, the inlet and outlet of the recirculation line connected to the supply line, the inlet of the recirculation line connected to the supply line upstream of the dispense valve;

an ice maker coupled to the recirculation line;

an ice maker valve coupled to the recirculation line, the ice maker valve operable to regulate liquid flow through the ice maker on the recirculation line;

a reservoir coupled to the recirculation line;

a pump coupled to the recirculation line, the pump operable to recirculate liquid from the reservoir through the ice maker via the recirculation line; and a recirculation check valve coupled to the recirculation line, the recirculation check valve blocking backward liquid flow through the recirculation line.

2. The plumbing system of claim 1, further comprising an ion exchange or water treatment filter coupled to the recirculation line.

3. The plumbing system of claim 1, further comprising a filter coupled to the supply line upstream of the inlet of the recirculation line.

4. The plumbing system of claim 1, wherein the reservoir is sized to hold no more than a half-gallon of liquid and no less than a tenth of a gallon of liquid.

5. The plumbing system of claim 1, further comprising a drain line and a drain check valve, the drain line connected to the recirculation line and extending to an additional dispense point, the drain check valve coupled to the drain line.

6. The plumbing system of claim 5, wherein an opening pressure of the drain check valve is greater than an opening pressure of the recirculation check valve.

7. The plumbing system of claim 1, further comprising a drain line and a drain check valve, the drain line connecting the outlet of the recirculation line to the supply line downstream of the dispense valve.

8. The plumbing system of claim 7, wherein an opening pressure of the drain check valve is greater than an opening pressure of the recirculation check valve.

9. The plumbing system of claim 1, wherein the outlet of the recirculation line is connected to the supply line upstream of the inlet of the recirculation line.

10. A plumbing system for an ice maker, comprising:

a supply line extending to a dispense point;

a dispense valve coupled to the supply line, the dispense valve operable to regulate liquid flow through the supply line to the dispense point;

a recirculation loop;

a recirculation inlet line connected to the supply line and the recirculation loop;

an ice maker valve coupled to the recirculation inlet line, the ice maker valve operable to regulate liquid flow into the recirculation loop through the recirculation inlet line;

a recirculation outlet line connected to the supply line and the recirculation loop;

a drain check valve coupled to the recirculation outlet line, the drain check valve blocking liquid flow into the recirculation loop through the recirculation outlet line;

a recirculation check valve coupled to the recirculation loop, the recirculation check valve blocking backward liquid flow through the recirculation loop;

an ice maker coupled to the recirculation loop;

a reservoir coupled to the recirculation loop; and a pump coupled to the recirculation loop, the pump operable to recirculate liquid from the reservoir through the ice maker via the recirculation loop, wherein an opening pressure of the drain check valve is less than an opening pressure of the recirculation check valve.

11. The plumbing system of claim 10, further comprising:

an ion exchange or water treatment filter coupled to the recirculation loop; and a filter coupled to the supply line upstream of the recirculation inlet line.

12. The plumbing system of claim 10, wherein the reservoir is sized to hold no more than a half-gallon of liquid and no less than a tenth of a gallon of liquid.

13. A refrigerator appliance, comprising the plumbing system of claim 1, wherein the dispense point is positioned at the dispenser recess on an exterior of the refrigerator appliance.

14. The refrigerator appliance of claim 13, wherein the dispenser recess is positioned on a door of the refrigerator appliance.

15. A refrigerator appliance, comprising the plumbing system of claim 10, wherein the dispense point is positioned at a dispenser recess on an exterior of the refrigerator appliance.

16. The refrigerator appliance of claim 15, wherein the dispenser recess is positioned on a door of the refrigerator appliance.

* * * * *